United States Patent [19]

Gename

[11] 4,220,293

[45] Sep. 2, 1980

[54] HOSE CARRIER

[75] Inventor: John L. Gename, Naperville, Ill.

[73] Assignee: Richco Plastic Company, Chicago, Ill.

[21] Appl. No.: 88,550

[22] Filed: Oct. 26, 1979

[51] Int. Cl.[3] ..... B65H 75/38; B65H 75/28

[52] U.S. Cl. ..... 242/86.1; 242/74.1; 242/96

[58] Field of Search ..... 242/86.1, 86, 96, 86.2, 242/74, 74.1; 191/12.2 R, 12.4

[56] References Cited

U.S. PATENT DOCUMENTS

| | | | |
|---|---|---|---|
| 3,578,258 | 5/1971 | Gronton | 242/74.1 |
| 4,061,290 | 12/1977 | Harrill | 242/96 |

FOREIGN PATENT DOCUMENTS

| | | | |
|---|---|---|---|
| 929975 | 6/1963 | United Kingdom | 242/86.1 |

*Primary Examiner*—Edward J. McCarthy
*Attorney, Agent, or Firm*—Martin Faier

[57] ABSTRACT

A device for storing and carrying collapsible hose comprising an enclosure having an aperture therein, a reel rotatable in the enclosure, means for rotating the reel, a fixture on and rotatable with the reel adapted for extension out of the enclosure through the aperture, the fixture having a tongue for gripping the hose intermediate its length to draw up the hose onto and around the reel upon rotation thereof, and a guide on the housing for maintaining the hose in windable position as the hose is drawn around the reel during rotation thereof, said hose being adapted for removal from the device upon rotation of the reel in a direction opposite to its hose winding direction.

14 Claims, 3 Drawing Figures

HOSE CARRIER

BACKGROUND AND SUMMARY OF THE INVENTION

This invention relates to a hose carrier and is more particularly directed to such a device having means for gripping a collapsible hose intermediate its length and drawing the hose onto a rotatable reel for storage and transport.

Collapsible hose generally comprises a plastic tube having a woven fabric covering, with fittings at each end of the hose. Such a length of hose may be collapsed to force liquid therefrom and to permit the hose to be tightly wound about itself, so that it may be transported and stored in a container of minimum dimensions, but which is readily available for use once the hose is unwound and removed from its storage container.

A hose carrier embodying the present invention is constructed so that the collapsed hose may be conveniently and easily inserted into the and removed from the hose carrier and used for storing and transporting the hose with all liquid removed therefrom thereby reducing its weight and dimensions. Such a hose carrier has a novel fixture adapted for gripping the hose intermediate its ends to draw up the hose onto and around a reel in the carrier and a guide for maintaining the hose in windable position as it is drawn around the reel, thus automatically forcing liquid from the hose and training it for winding as it is wound onto the reel. The hose carrier has a novel container which encloses the reel and an aperture in the container through which the hose secured onto the fixture is admitted into the container. Within the container is a reel, which may be wound by means of a handle or other element from the exterior of the container, and the reel carries the fixture. The fixture is novelly constructed as to provide at one end means for attaching it for movement with and on the reel, and at another end a torgue for gripping the hose, the fixture being flexible intermediate its ends to permit its winding about the reel. The guide is positioned relative to the aperture and constructed so that it will permit feeding of the hose in collapsed condition onto the reel during its rotation.

OBJECTS AND ADVANTAGES OF THE INVENTION

It is the object of the invention to provide a novel hose carrier of the character described.

Another object is to provide a hose carrier having novel means for drawing the hose in collapsed condition into the carrier wound around a reel rotatable therein.

Another object is to provide a novel fixture for gripping a hose intermediate its ends, the fixture being windable around a rotatable reel in a hose carrier.

Another object is to provide a novel tongue on a rotatable hose reel fixture for gripping a length of collapsed hose.

Another object is to provide a novel guide for a hose carrier which is adapted to present collapsed hose in windable condition to a rotatable reel in the carrier.

Another object is to provide a novel hose carrier structured for automatic pressing of liquid from the hose as the hose is wound up in the carrier.

Another object is to provide a hose carrier which is easy and economical to manufacture and assemble, and which is efficient and simple to use.

These and other objects and advantages of the invention will become more apparent as this description proceeds, taken in conjunction with the accompanying drawings.

DESCRIPTION OF A PREFERRED EMBODIMENT

Figure 1:
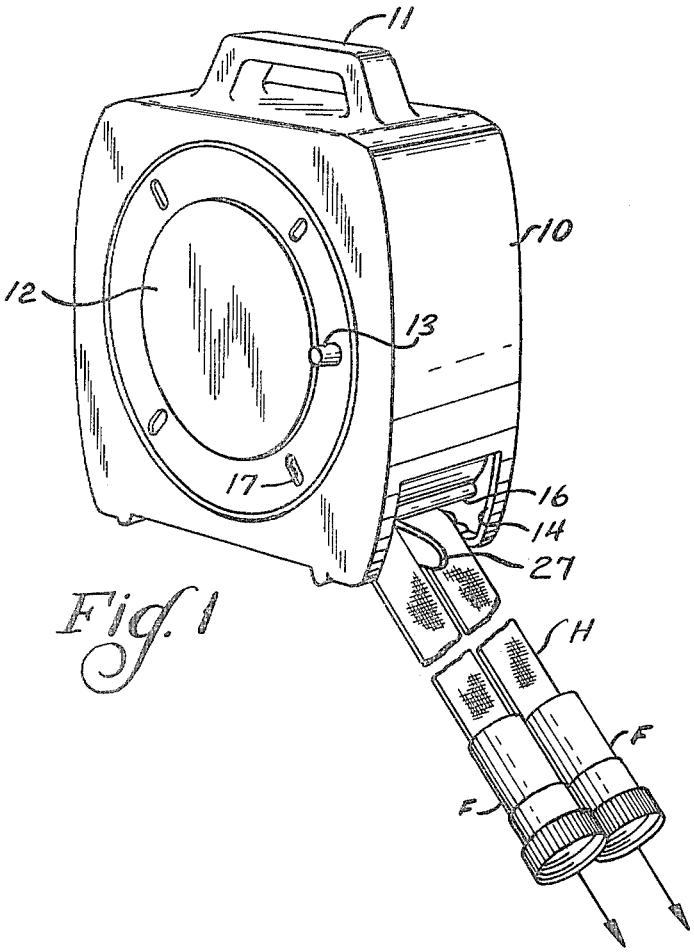
FIG. 1 is a perspective view of a hose carrier embodying the present invention.

With reference to the accompanying drawings, a length of hose H, preferably with fittings F on each end, is constructed from a length of plastic tubing T having a woven cover C, so that the hose may be easily collapsed when void of fluid.

The preferred embodiment of the invention consists of a plastic closure 10, having an integral molded handle 11, and a reel 12 rotatable within the closure by means of eccentric handle 13. One corner of the closure 10 has an aperture 14, through which a hose connecting fixture 15 may be extended, a wall of the aperture being formed with an inwardly downwardly nose 16 which acts as a guide for the fixture 15 when it is moved in the direction of the aperture, but which trains the fixture toward the reel when moved in an opposite direction.

Within the closure 10, and forming part of the rotatable reel 12 is a cylindrical body 20, and one end 21 of the fixture 15 is connected to the rotatable body 20, as by means of a nut and bolt assembly 22. A tab or tongue 26 is on the end of the fixture 15 remote from its fastener 22, positioned to be extendable from the closure 10 between the nose 16 and a guide 27 mounted centrally of the closure 10 and upstanding thereon.

Figure 2:
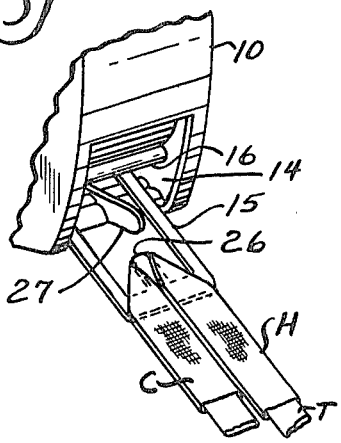
FIG. 2 is a detailed perspective view of a part of the closure, fixture and guide assembly of the hose carrier.
Figure 3:
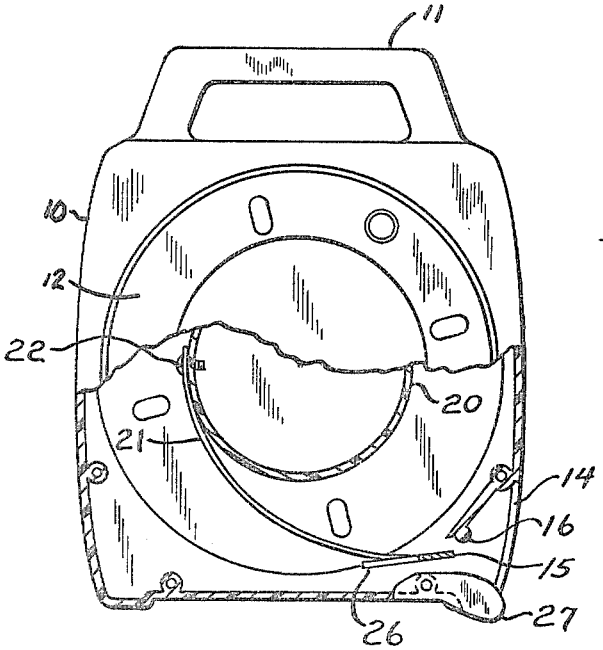
FIG. 3 is a plan view of the hose carrier, partially in section.

In use, the handle 13 is turned in a counterclockwise direction, thus rotating the reel 12 and body 20 to extend the fixture 15 out of the closure 10 through the aperture 14, to expose the tab 26, whereupon the hose H folded extermediate its ends may be threaded over the tab, as shown in FIG. 2. The reel 12 is then rotated in a reverse or clockwise direction, drawing the hose H around the body 20. As the hose is wound around the body, the guide 27 separates the length of hose into neat piles, preventing twisting, and the winding of the hose, drawn over the nose 16 during winding, tends to force the liquid therefrom, so the hose will lay flat when wound onto the reel body 20. The hose may be continued to be wound up within the carrier until the fittings F bear against the walls of the aperture 14, where they are unable to clear into the closure 10. When wound onto the reel, the hose may be conveniently stored and transported within the carrier. Unwinding of the hose for use may be easily accomplished by reversing the winding procedure described, until the hose may be lifted from the extended tab 26. The presence and amount of hose wound on the reel body 20 may be ascertained by viewing the wound hose through the slots 17 on the face of the reel 12.

While a preferred embodiment of the invention has been described in considerable detail, many changes and modifications in the structure described may be made without departing from the spirit or scope of the invention. Accordingly, it is not desired that the invention should be limited to the exact construction shown and described.

I claim:

1. A hose carrier for storing and transporting a length of collapsible hose comprising an apertured enclosure, a reel rotatable in said enclosure, means for rotating said reel, and a fixture extendable into said enclosure aperture and connected to and rotatable with said reel, said fixture having a tongue for removably gripping said hose and drawing it into said enclosure for winding onto said reel when said reel is rotated in one direction.

2. The hose carrier recited in claim 1, wherein said enclosure has a hose guide arranged in said aperture.

3. The hose carrier recited in claim 2, wherein said tongue is adapted for gripping said hose intermediate its length and said guide is positioned upstanding fixed on said enclosure axially centrally of said fixture and reel to separate said hose into a pair of spans windable in aligned piles on said reel as said reel is rotated.

4. The hose carrier recited in claim 1, wherein said enclosure has a wall extending into said aperture positioned relative to said fixture for bearing against said hose as it is drawn into said enclosure.

5. The hose carrier recited in claim 4, wherein said wall has a nose on a free edge thereof adapted for pressing against and collapsing said hose as it is wound onto said reel.

6. The hose carrier recited in claim 1, wherein said rotating means comprises a handle eccentrically arranged on said reel.

7. The hose carrier recited in claim 6, wherein a slot is arranged on said reel for viewing hose wound thereon.

8. The hose carrier recited in claim 1, wherein a handle is formed integrally with said enclosure for transporting said carrier.

9. The hose carrier recited in claim 1, wherein said fixture comprises a flexible strap secured to said reel at its end remote from said tongue.

10. The hose carrier recited in claim 1, wherein said reel comprises a spool having a cylindrical body and an upstanding peripheral edge.

11. The hose carrier recited in claim 10, wherein one end of said fixture is secured tangentially to said body.

12. The hose carrier recited in claim 11, wherein said tongue is arranged on said fixture remote from said body and extends away from said reel.

13. The hose carrier recited in claim 1, wherein said reel is rotatable in a reverse direction when said hose is pulled in a direction opposed to its winding direction.

14. The hose carrier recited in claim 13, wherein rotation of said reel in said one direction is stopped by a wall of said enclosure when said fixture is extended into said enclosure aperture.

* * * * *